US006146217A

United States Patent [19]

Osada

[11] Patent Number: 6,146,217

[45] Date of Patent: Nov. 14, 2000

[54] TERMINAL UNIT

[75] Inventor: Yutaka Osada, Hachioji, Japan

[73] Assignee: Osada Co., Ltd., Hachioji, Japan

[21] Appl. No.: 09/359,810

[22] Filed: Jul. 23, 1999

[30] Foreign Application Priority Data

Jul. 30, 1998 [JP] Japan ..... 10-230332

[51] Int. Cl.[7] ..... H01R 4/48

[52] U.S. Cl. ..... 439/835; 439/441; 439/817

[58] Field of Search ..... 439/441, 725, 439/729, 817, 835

[56] References Cited

U.S. PATENT DOCUMENTS 3,858,164 12/1974 Leonard .
5,277,613 1/1994 Neward ..... 439/729
5,993,270 11/1999 Geske et al. ..... 439/835
6,004,168 12/1999 Fuchs et al. ..... 439/835

*Primary Examiner*—Khiem Nguyen
*Attorney, Agent, or Firm*—Finnegan, Henderson, Farabow, Garrett & Dunner, L.L.P.

[57] ABSTRACT

A terminal unit having a metal terminal for holding an electrically conductive wire in cooperation with a plate spring, wherein a push button 6 is operated in one direction to rotatably disengage one end 4*a* of the plate spring 4 from the metal terminal 3 against the spring action of a compression coil spring 5 which is in engagement with the opposite end 4*c* of the plate spring, the plate spring being bent at the intermediate portion thereof to provide an attaching portion 4*b* with which the plate spring may be rotatably supported on a support pin 21. In particular, the push button, the plate spring and the compression coil spring are used in combination with the principle of a lever so that the plate spring any be disengaged from the metal terminal with a relatively small force applied to the push button.

5 Claims, 10 Drawing Sheets

TERMINAL UNIT

BACKGROUND OF THE INVENTION

The present invention relates to a terminal unit, and more particularly relates to a one-touch operating terminal unit having a push button which may be lightly pushed to easily and fixedly hold an electrically conductive wire of a single thick line or a wire of a plurality of bundled or twisted thinner lines which may be loosened to swell by utilizing a compression spring in connection with the push button so as to be compressed with a principal of lever to produce a large stroke of operation with application of a light operating force thereto.

So far there have been proposed many terminal units having a one-touch push button which is operated to hold the electrically conductive wire. Such terminal units are generally provided with a plate spring only or a plate spring and a compression spring arranged in combination in connection with the push button.

In case of the terminal unit provided with the plate spring only, the plate spring has a hard spring property to hold the electrically conductive wire with a strong force. However the hard spring property (a large spring constant) will progressively require a stronger force as the push button is pressed down. In other words, the plate spring may be pressed at first with a stroke which is caused by relatively weak force applied to the push button, but will be abruptly heavy during the stroke of operation. In order to press the plate spring to the end of stroke, a maximum force of about 21.6N (2.2 kgf) is required.

The terminal unit is manually operated to hold the electrically conductive wire. Since the push button is so small, the finger top or finger nail will be subjected to a heavy load which will give a considerable pain to the finger top or finger nail when pushing down the push button to connect the electrically conductive wire to the terminal unit.

Thus the finger top or finger nail is required to apply a considerably strong force to the push button until the plate spring is pressed down to allow the electrically conductive wire to be inserted. This will often cause the terminal unit to fail to correctly hold such a wire of a plurality of bundled or twisted wires which may loosen apart from each other. It is, therefore, required to provide a terminal unit for the electrically conductive wire of single thick line and another terminal unit for the wire of a plurality of bundled or twisted thinner lines.

Even in case of the terminal unit provided with a plate spring and a compression coil spring in combination, the moving direction of the push button is not in alignment with the compressing direction of the compression coil spring, causing it difficult to produce a required light and large stroke of operation when the push button is pushed. Further the terminal unit fails to have the plate spring and the compression coil spring arranged in a stabilized engagement with each other. These two parts are, therefore, displaced from each other during the stroke thereof due to pushing operation of the push button, causing the pushing operation to be unsmooth and causing the wire holding force to be unstabilized.

OBJECTS OF THE INVENTION

It is, therefore, an object of the invention to eliminate these defects and disadvantages of the prior art and provide a terminal unit having a push button, a plate spring and a compression coil spring provided in combination, wherein the push button, the plate spring and the compression coil spring are arranged substantially in alignment with each other, so that the push button may be easily and smoothly operated to rotatingly disengage the plate spring from a metal terminal of the terminal unit while the plate spring is elastically deformed against the spring action of the compression coil spring.

It is another object of the invention to bend the plate spring at the intermediate thereof to provide the opposite ends and the intermediate attaching portion with which the plate spring is rotatably supported on a support pin extending laterally of a casing of the terminal unit, one of the opposite ends being provided with a projection. The compression coil spring engages the projection to normally maintain the other of the opposite ends of the plate spring in contact with the metal terminal of the terminal unit, so that the push button may be easily and smoothly operated to rotatingly disengage the plate spring from the metal terminal of the terminal unit while the plate spring is elastically deformed against the spring action of the compression coil spring without causing displacement between the plate spring and the compression coil spring.

It is another object of the invention to provide a terminal unit having a casing and a metal terminal arranged in the casing and comprising a plate spring bent at the intermediate thereof to provide an attaching portion therefor and opposite ends providing an opening therebetween, one of said ends having a projection formed thereat; a support pin extending laterally of the casing for engaging the attaching portion of the plate spring for rotatably supporting the plate spring; a compression coil spring positioned in the casing and having one end portion for engaging the projection of said one end of the plate spring and normally pressing the other end of said plate spring against the metal terminal; and a push button operated in one direction to press said other end of the plate spring against the spring action of the compression coil spring, thereby to rotatingly disengage said other end of the plate spring from the metal terminal and provide a gap between the metal terminal and said other end of the plate spring for allowing the electrically conductive wire to be inserted therethrough, while the plate spring is elastically deformed against the spring action of the compression coil spring which is compressed as the plate spring is elastically deformed. The push button, the compression coil spring and the plate spring are arranged substantially in alignment with each other while the plate spring is arranged in such a manner as a straight line passing the bent portion and the opening of the plate spring extends in a direction substantially normal to the direction in which the push button is operated, so that the different spring properties of the plate spring and the compression coil spring may be effectively combined. As the result, the force required to push the push button is reduced to 1.1 kgf at most which is approximately ½ of the force (about 2.2 kgf) of the case of the conventional terminal unit with the additional merit enabling the push button to have a large stroke of operation for conveniently hold the electrically conductive wire of a single thick line or the wire of plural bundled or twisted thinner lines which may be loosened to swell.

It is another object of the invention to bend the plate spring at the intermediate thereof in a shape of hair pin to provide an attaching portion and opposite ends, one of which has a projection formed thereat, so that the plate spring may be rotatably supported on the support pin of the casing while the projection is arranged in engagement with the compression coil spring, and further so that the relatively soft compression coil spring and the plate spring may be operated with a principle of lever with application of a small force to the push button, thereby to hold the electrically conductive wire in cooperation with the metal terminal of the terminal unit.

It is still another object of the invention to provide the metal terminal with the leads which extend in the same direction as the direction in which the push button is operated, the direction being normal to the plane of the printed board to which the terminal unit is mounted, so that the terminal unit may be easily attached to the printed board which is specified to allow a relatively taller terminal unit to be attached thereto.

It is still another object of the invention to provide the metal terminal with the lead in the shape of L, the essential portion of which extends in the direction normal to the direction in which the push button is operated, that is, extending in parallel with the plane of the printed board to which the terminal unit is attached, so that the terminal unit may be attached to the printed board as being inclined at 90° when the printed board is specified to restrain the height of the terminal unit to be attached thereto.

It is still another object of the invention to provide a push button having a head arranged substantially within the casing of the terminal unit where the head is not accessible with hand, so that the electrically conductive wire, which has been held in the terminal unit, will not be released by occasional touch of fingers to the head.

SUMMARY OF THE INVENTION

The present invention relates to a terminal unit having a casing containing therein a metal terminal so structured as to hold an electrically conductive wire in cooperation with a plate spring with electrically conductive connection established between the metal terminal and the electrically conductive wire, said terminal unit comprising said plate spring bent at the intermediate thereof to provide an attaching portion therefor and opposite ends, one of said ends having a projection formed thereat; a support pin extending laterally of said casing for engaging said attaching portion of said plate spring for rotatably supporting said plate spring; a compression coil spring positioned in said casing and having one end portion for receiving said projection of said one end of said plate spring and normally pressing the other end of said plate spring against an edge of said metal terminal; and a push button operated in one direction to press said other end of said plate spring against the spring action of said compression coil spring, thereby to rotatingly disengage said other end of said plate spring from said edge of said metal terminal and provide a gap between said edge of said metal terminal and said other end of said plate spring for allowing said electrically conductive wire to be inserted therethrough, said push button, said compression coil spring and said plate spring being arranged in substantially alignment with each other so that said operation of said push button in said one direction may cause rotation of said plate spring while being elastically deformed which may simultaneously compress said compression coil spring.

The present invention relates to a terminal unit having a casing containing therein a metal terminal so structured as to hold an electrically conductive wire in cooperation with a plate spring with electrically conductive connection established between the metal terminal and the electrically conductive wire, said terminal unit comprising said plate spring bent at the intermediate thereof in a shape of hair pin to provide an attaching portion therefor and opposite ends defining an opening therebetween, one of said ends having a projection formed thereat; a support pin extending laterally of said casing for engaging said attaching portion of said plate spring for rotatably supporting said plate spring; a compression coil spring positioned in said casing and having one end portion for receiving said projection of said one end of said plate spring and normally pressing the other end of said plate spring against an edge of said metal terminal; and a push button having a head protruded out from said casing so as to be operated thereat, said push button being pushed in one direction to press said other end of said plate spring against the spring action of said compression coil spring, thereby to rotatingly disengage said other end of said plate spring from said edge of said metal terminal and provide a gap between said edge of said metal terminal and said other end of said plate spring for allowing said electrically conductive wire to be inserted therethrough, said push button, said compression coil spring and said plate spring being arranged in substantially alignment with each other while said plate spring is arranged in such a manner as a straight line passing said bent portion and said opening of said plate spring extending in a direction normal to said direction in which said push button is operated so that said pushing operation of said push button may cause rotation of said plate spring while being elastically deformed which may simultaneously compress said compression coil spring.

The present invention relates to a terminal unit having a casing containing therein a metal terminal so structured as to hold an electrically conductive wire in cooperation with a plate spring with electrically conductive connection established between the metal terminal and the electrically conductive wire, said terminal unit comprising said plate spring bent at the intermediate thereof in a shape of hair pin to provide an attaching portion therefor and opposite ends defining an opening therebetween, one of said ends having a projection formed thereat; a support pin extending laterally of said casing for engaging said attaching portion of said plate spring for rotatably supporting said plate spring; a compression coil spring positioned in said casing and having one end portion for receiving said projection of said one end of said plate spring and normally pressing the other end of said plate spring against an edge of said metal terminal; and a push button having a head protruded out from said casing so as to be operated thereat, said push button being pushed in one direction to press said other end of said plate spring against the spring action of said compression coil spring, thereby to rotatingly disengage said other end of said plate spring from said edge of said metal terminal and provide a gap between said edge of said metal terminal and said other end of said plate spring for allowing said electrically conductive wire to be inserted therethrough, said push button, said compression coil spring and said plate spring being arranged in substantially alignment with each other while said plate spring is arranged in such a manner as a straight line passing said bent portion and said opening of said plate spring extending normal to said direction in which said push button is operated so that said pushing operation of said push button may cause rotation of said plate spring while being elastically deformed which may simultaneously compress said compression coil spring, said metal terminal having a plurality of leads extending in a direction normal to a plane of a printed board to which said terminal unit is mounted.

The present invention relates to a terminal unit having a casing containing therein a metal terminal so structured as to hold an electrically conductive wire in cooperation with a plate spring with electrically conductive connection established between the metal terminal and the electrically conductive wire, said terminal unit comprising said plate spring bent at the intermediate thereof in a shape of hair pin to provide an attaching portion therefor and opposite ends defining an opening therebetween, one of said ends having a projection formed thereat; a support pin extending laterally of said casing for engaging said attaching portion of said plate spring for rotatably supporting said plate spring; a compression coil spring positioned in said casing and having one end portion for receiving said projection of said one end of said plate spring and normally pressing the other end of said plate spring against an edge of said metal terminal; and a push button having a head protruded out from said casing so as to be operated thereat, said push button being pushed in one direction to press said other end of said plate spring against the spring action of said compression coil spring, thereby to rotatingly disengage said other end of said plate spring from said edge of said metal terminal and provide a gap between said edge of said metal terminal and said other end of said plate spring for allowing said electrically conductive wire to be inserted therethrough, said push button, said compression coil spring and said projection of said one end and said other end of said plate spring being arranged in substantially alignment with each other while said plate spring is arranged in such a manner as a straight line passing said bent portion and said opening of said plate spring extending normal to said direction in which said push button is operated so that said pushing operation of said push button may cause rotation of said plate spring while being elastically deformed which may simultaneously compress said compression coil spring, said metal terminal having a least one lead in a shape of L, essential part of which extending in a direction parallel to a plane of a printed board to which said terminal unit is mounted.

The present invention relates to a terminal unit having a casing containing therein a metal terminal so structured as to hold an electrically conductive wire in cooperation with a plate spring with electrically conductive connection established between the metal terminal and the electrically conductive wire, said terminal unit comprising said plate spring bent at the intermediate thereof in a shape of hair pin to provide an attaching portion therefor and opposite ends defining an opening therebetween, one of said ends having a projection formed thereat; a support pin extending laterally of said casing for engaging said attaching portion of said plate spring for rotatably supporting said plate spring; a compression coil spring positioned in said casing and having one end portion for receiving said projection of said one end of said plate spring and normally pressing the other end of said plate spring against an edge of said metal terminal; and a push button having a head normally positioned substantially inside of said casing so as to be operated thereat by means of a tool, said push button being pushed in one direction to press said other end of said plate spring against the spring action of said compression coil spring, thereby to rotatingly disengage said other end of said plate spring from said edge of said metal terminal and provide a gap between said edge of said metal terminal and said other end of said plate spring for allowing said electrically conductive wire to be inserted therethrough, said push button, said compression coil spring and said projection of said one end and said other end of said plate spring being arranged in substantially alignment with each other while said plate spring is arranged in such a manner as a straight line passing said bent portion and said opening of said plate spring extending normal to said direction in which said push button is operated, so that said pushing operation of said push button may cause rotation of said plate spring while being elastically deformed which may simultaneously compress said compression coil spring.

BRIEF DESCRIPTION OF THE DRAWINGS

FIGS. 1 through 12 and 16 show a first embodiment of the invention, wherein FIG. 1 is an oblique view of a terminal unit of the invention shown with an end plate being detached from the terminal unit;

FIG. 2 is an oblique view of the terminal unit shown as being exploded;

FIG. 3 is an oblique view of the terminal unit having a push button assembled thereto;

FIG. 4 is a different oblique view of the terminal unit;

FIG. 5 is a side elevational view of the terminal unit;

FIG. 6 is a front elevational view of the terminal unit shown as being partly sectioned;

FIG. 7 is a side elevational view of the essential parts of the terminal unit shown in vertical section and showing a condition for holding an electrically conductive wire;

FIG. 8 is a front elevational view of the essential parts of the terminal unit shown in vertical section to show the condition for holding the electrically conductive wire;

FIG. 9 is a side elevational view of the terminal unit partly broken to show the condition for holding the electrically conductive wire;

FIG. 10 is an oblique view of the end plate of the terminal unit provided with a device for removing the sheathing of the electrically conductive wire;

FIG. 11 is a side elevational view of the terminal unit partly broken to show the condition wherein the terminal unit is operated to allow the electrically conductive wire t o be inserted thereinto;

FIG. 12 is a side elevational view of the terminal unit partly broken to show the condition wherein the terminal unit is operated to hold the inserted electrically conductive wire;

FIGS. 14 and 15 show a third embodiment of the terminal unit of the invention, wherein FIG. 14 is an oblique view of the terminal unit;

FIG. 15 is a side elevational view of the terminal unit partly broken to show the condition wherein the terminal unit is operated to hold the electrically conductive wire; and FIG. 16 is a side elevational view of the terminal unit mounted on a printed board shown partly in section.

DETAILED DESCRIPTION OF THE PREFERRED EMBODIMENTS

Figure 1:
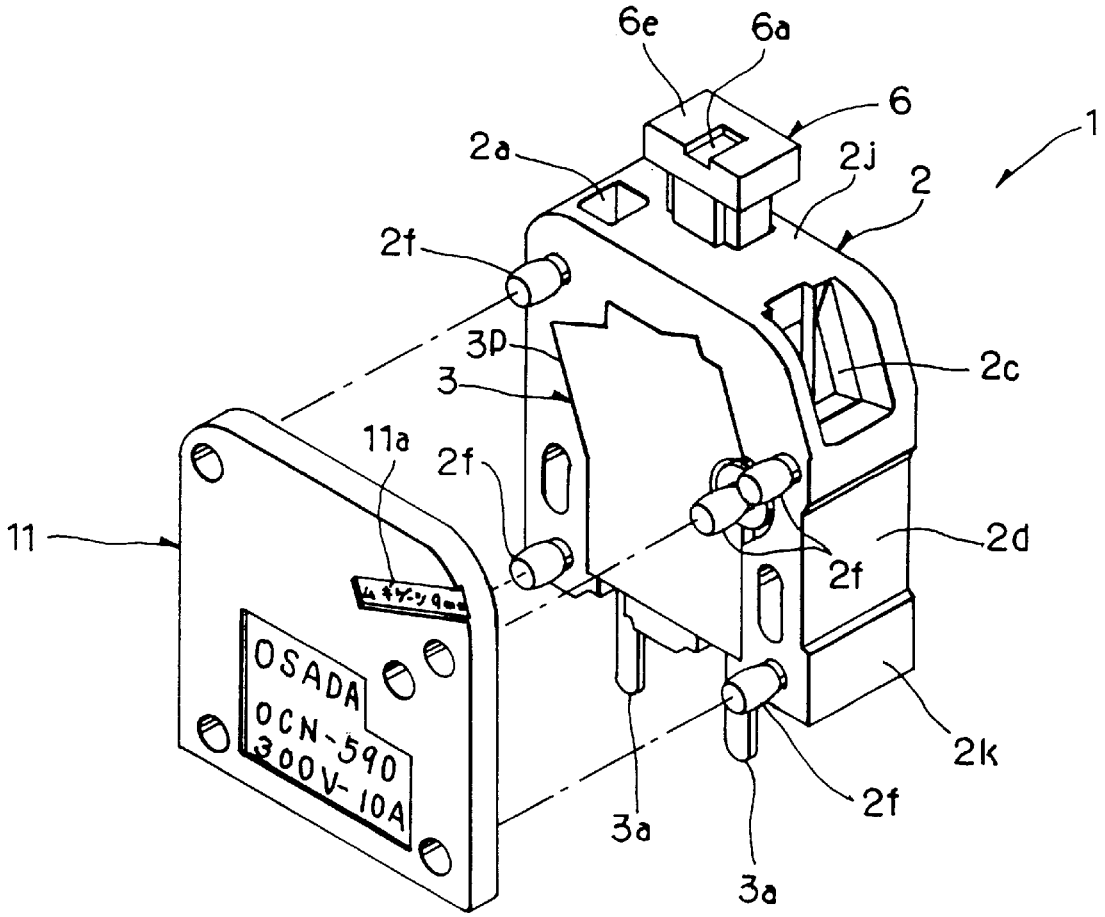

The invention will now be described in reference to the preferred embodiments as shown in the attached drawings. In reference to FIGS. 1 through 6, a terminal unit 1 of a first embodiment includes a casing 2, a metal terminal 3, a compression coil spring 5 and a push button 6.

The casing 2 is a base which is made of an electrically non-conductive material such as a synthetic resin, and is so structured as to mount thereon the metal terminal 3, the compression coil spring 5 and the push button 6 are mounted. The casing 2 has an opening 2*a* provided at the top 2*j* thereof for confirming if the electrically conductive wire is correctly held or not. The casing 2 further has a guide opening 2*b* in the shape of ⊏ in cross section provided at the top 2*j* thereof for receiving therein the push button 6.

The casing 2 has a wire introducing opening 2*c* provided at the an upper part of the front wall 2*k* thereof for allowing an electrically conductive wire 8 to be inserted therethrough into the casing 2. The casing 2 has a recessed part 2*d* formed at an intermediate part of the front wall 2*k* thereof for facilitating an operator to hold the terminal unit 1 with fingers.

Figure 4:
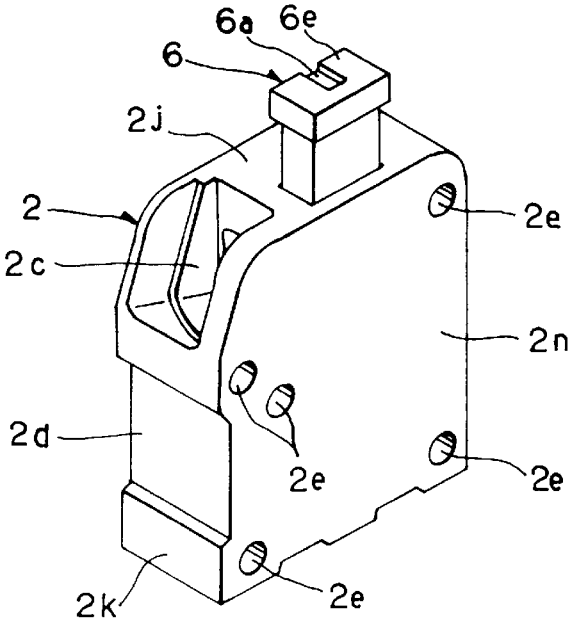

As particularly shown in FIG. 4, the casing 2 has a plurality of connecting holes 2*e*, five holes by way of example, provided on the right side wall 2*n* thereof. As particularly shown in FIG. 3, the casing 2 has the same number of projections 2*f* provided on the left side wall 2*p* thereof in correspondence to the connecting holes 2*e* respectively. The casing 2 has a side rear wall 2*q* opposite to the front side wall 2*k*. The rear side wall 2*q* has a block as a stopper 2*g* formed on the inner side thereof at a position in alignment with the electrically conductive wire inserting direction from the wire introducing opening 2*c* for engaging the end of the electrically conductive wire 8 as the latter is inserted through the wire introducing opening 2*c* and regulating the inserting amount of the wire. The casing 2 has a seat 2*h* in a shape of ⊐ in vertical section provided below the guide opening 2*b* on the bottom thereof. The seat 2*h* has a width which is slightly larger than the external diameter of the compression coil spring 5 for receiving therein the lower part of the compression coil spring 5. The casing 2 has a support pin 2*i* for supporting the plate spring 4. The support pin 4 is extended laterally from the right side wall 2*n* and adjacent to the front side wall 2*d* of the casing between the guide opening 2*b* and the seat 2*h*. One of the projections 2*f* is formed on the support pin 2*i* axially thereof. The end plate 11 is attached to the casing 2 by means of the connecting projections 2*f*.

Figure 2:
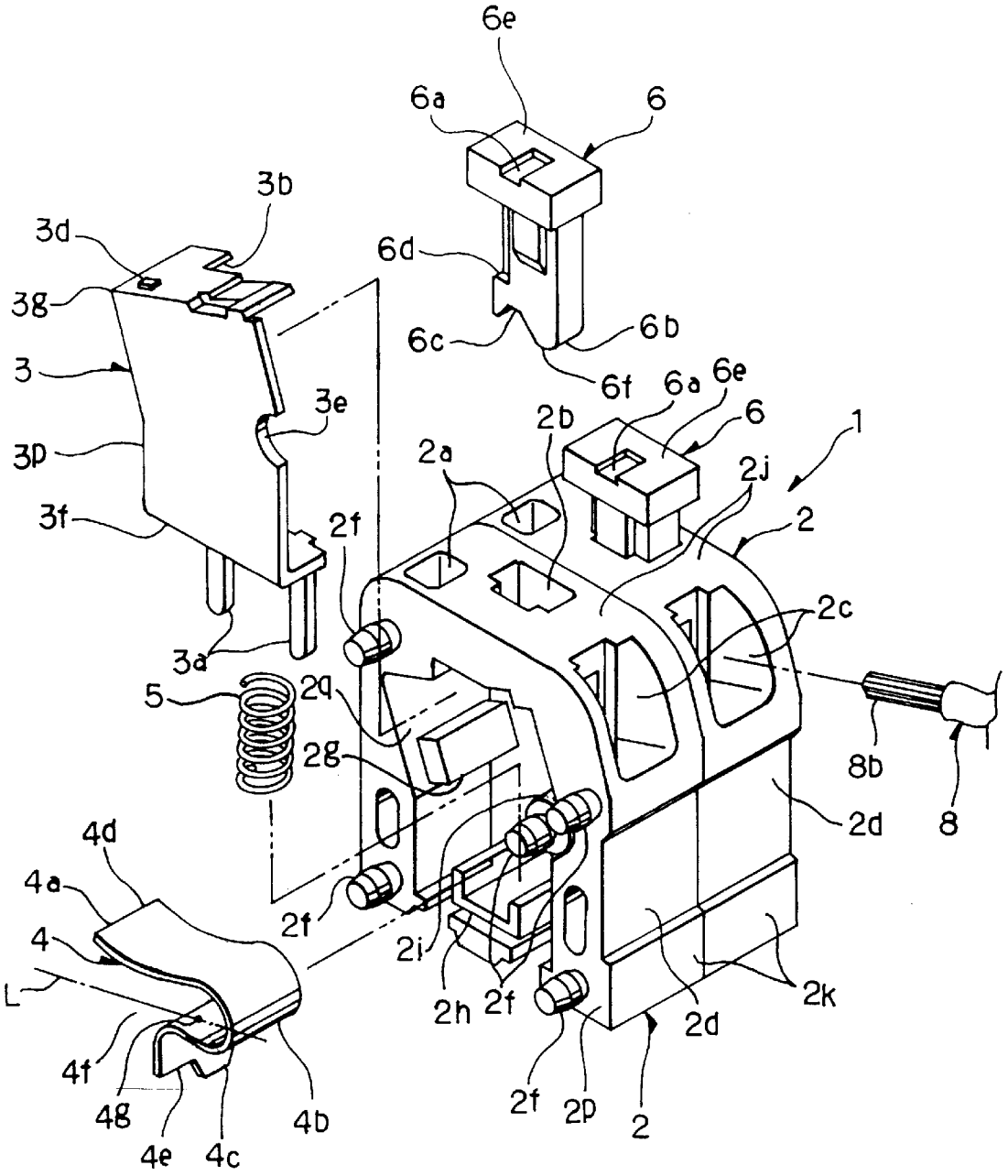
Figure 3:
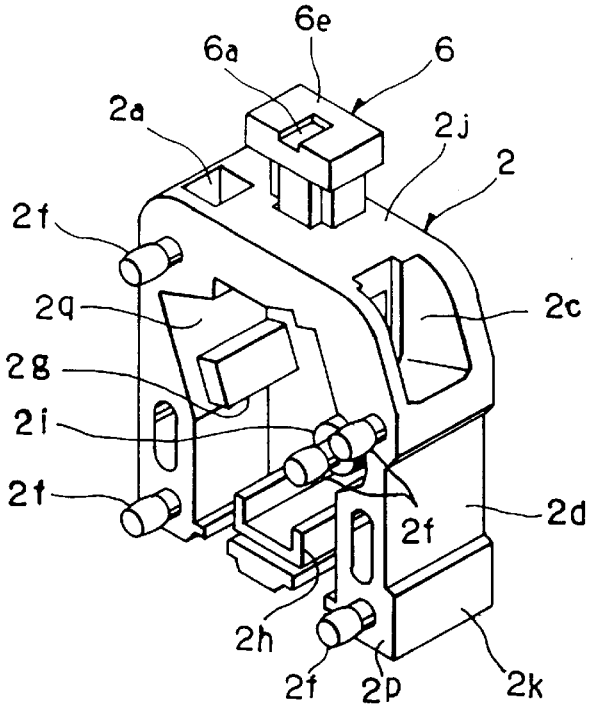

As particularly shown in FIG. 2, the metal terminal 3 is provided to take out the electric conduction from the terminal unit 1. The metal terminal 3 is made of a copper alloy or the like which is plated with an electrically conductive material and is formed in a shape of ⊐ in vertical section as shown. The metal terminal 3 has a lower bent portion 3*f* which has a pair of downwardly extending straight leads 3*a* formed integrally therewith so as to be so many parts to be in electric contact with the printed circuits of a printed board 9 when the terminal unit 1 is attached to the printed board 9.

Figure 7:
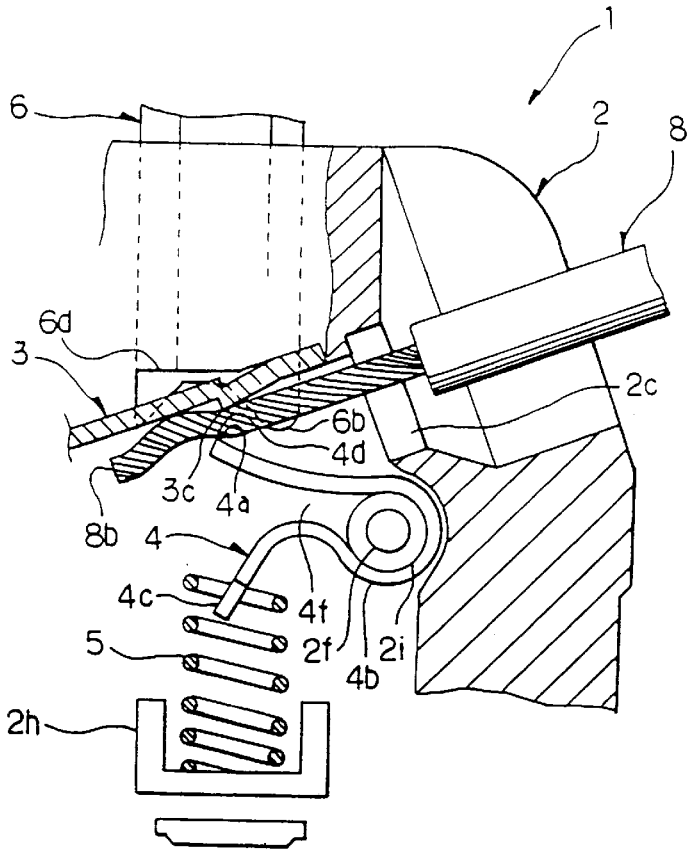
Figure 8:
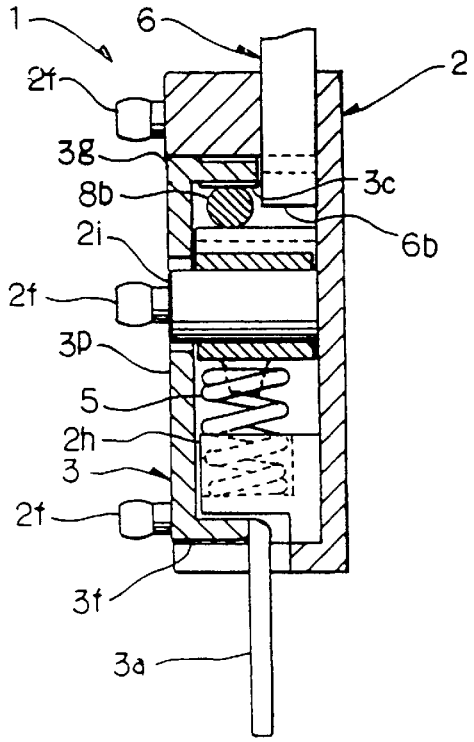
Figure 9:
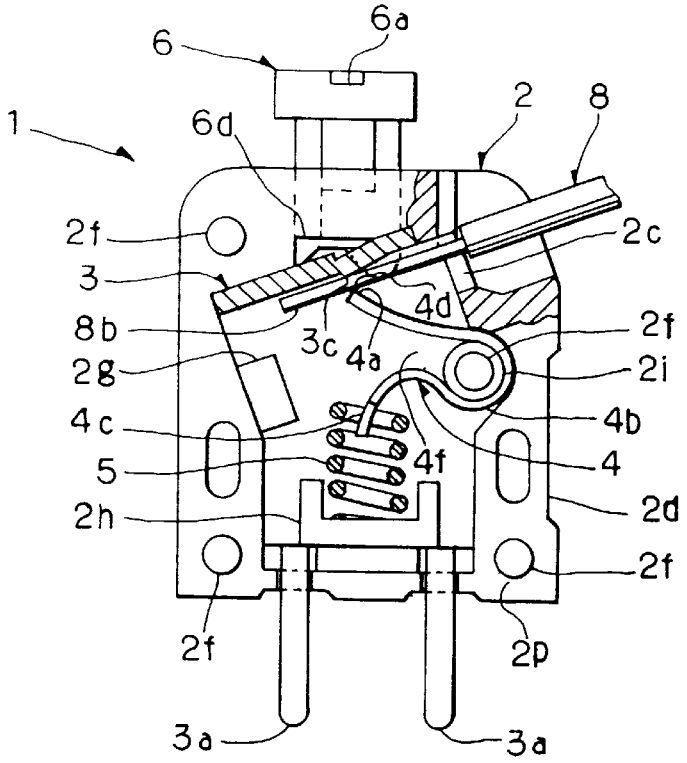

The metal terminal 3 has an upper bent portion 3*g* which has a cut out portion 3*b* for facilitating the vertical movements of the push button 6 as will be described in detail. As particularly show in FIGS. 7 and 12, the metal terminal 3 has an edge 3*c* formed integrally therewith in the neighborhood of the cutout portion 3*b*. The edge 3*c* is provided to hold the electrically conductive wire 8 in cooperation with a wire pressing portion 4*a* of the plate spring 4. The edge 3*c* is so formed as to firmly bite the single electrically conductive wire to provide a stabilized hold of the wire, and to firmly contact the wire of a plurality of bundled or twisted wires in a manner as to flatten the wire to enlarge the contacting area of the wire thus to secure a better electric conduction. The edge 3*c* has a rearward projection 3*d* formed integrally therewith. The projection 3*d* is placed in engagement with the confirming opening 2*a* of the casing 2 when the metal terminal 3 is fitted to the casing 2. The metal terminal 3 has opposite sides 3*p*, one of which having an arcuate cutout 3*e* formed thereat for allowing the support pin 2*i* of the casing 2 to pass therethrough when the metal terminal 3 is fitted to the casing 2.

As particularly in FIG. 2, the plate spring 4 is made of a steel strip or the like which is bent in the shape of a hair pin with a round bent portion 4*b* providing an upper part extending in a slightly curved state with a termination 4*d* which acts as a wire pressing part 4*a*. The plate spring 4 has a lower part which is bent down halfway and is terminated with a lower end 4*e* having a downward tapered projection 4*c* formed therewith for engaging the inner diametrical part of the compression coil spring 5. The projection 4*c* is tapered to facilitate the assembling operation for engaging the projection 4*c* into the compression coil spring 5. Further the distance between the curvature center 4*g* of the round bent portion 4*b* and the wire pressing part 4*a* is longer than the distance between the curvature center 4*g* and the tapered projection 4*c* so that the plate spring 4 may act on the compression spring 5 with an increased force by the principle of lever when the plate spring 4 is pressed down by the push button 6.

When the round bent portion 4*b* of the plate spring 4 is fitted to the support pin 2*i* of the casing 2, the plate spring 4 is rotatably supported on the support pin 2*i* and the straight line L passing the round bent portion 4*b* and the opened part 4*f* of the plate spring 4 is substantially normal to the direction in which the push button 6 is pushed.

The push button 6 is provided so as to be vertically pushed in the guide opening 2*b* of the casing 2 against the spring action of the plate spring 4 which has the lower tapered projection 4*c* engaging the upper part of the compression coil spring 5. More precisely, the push button 6 is made of an electrically non-conductive material just like the casing 2 and has an enlarged flat head 6*e* protruded out from the guide opening 2*b* of the casing 2 as shown in FIG. 1.

The head 6*e* of the push button 6 has a recess 6*a* formed at the top thereof so as to be receive the tip of a tool such as a driver (screw driver) by which the push button 6 is pushed down. As particularly shown in FIGS. 2 and 5, the push button 6 has a lower end 6*f* having an upwardly recessed part defined by a lower projection 6*b* and an upper recess 6*c*, so that the lower end of the push button 6 may fixedly engage the wire pressing part 4*a* of the plate spring 4.

The push button 6 has a shank in the shape of ⊏ in cross section to fit to the shape of the cross section of the guide opening 2*b* of the casing 2 so that the push button 6 will not be inserted into the guide opening in a wrong way when the terminal unit 1 is assembled.

The push button 6 has a shoulder 6*d* formed on the shank thereof for engaging an abutment (not shown) of the casing 2 when once the push button 6 is inserted into the guide opening 2*b* and preventing the push button 6 from slipping out from the guide opening 2*b*.

Figure 5:
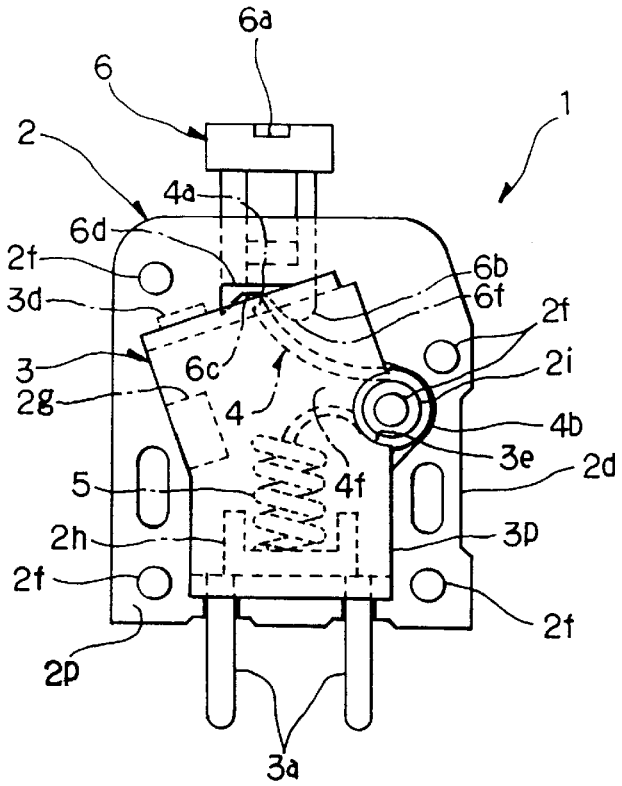
Figure 6:
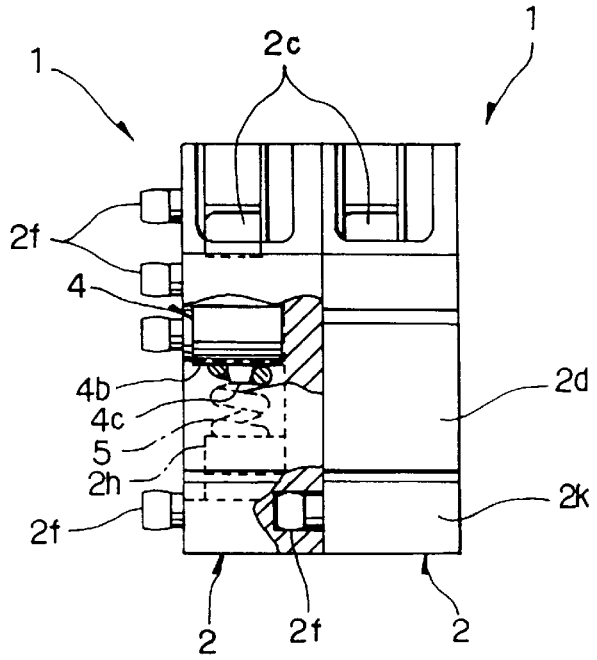

As particularly shown in FIG. 5 where the essential parts of the terminal unit 1 are assembled in the casing 2, the direction in which the push button 6 is pushed is placed in alignment with the axial direction of the compression coil spring 5. The straight line L (FIG. 2) passing the round bent portion 4*b* and the opened part 4*f* of the plate spring 4 is placed normal to the direction in which the push button 6 is pushed.

Figure 13:
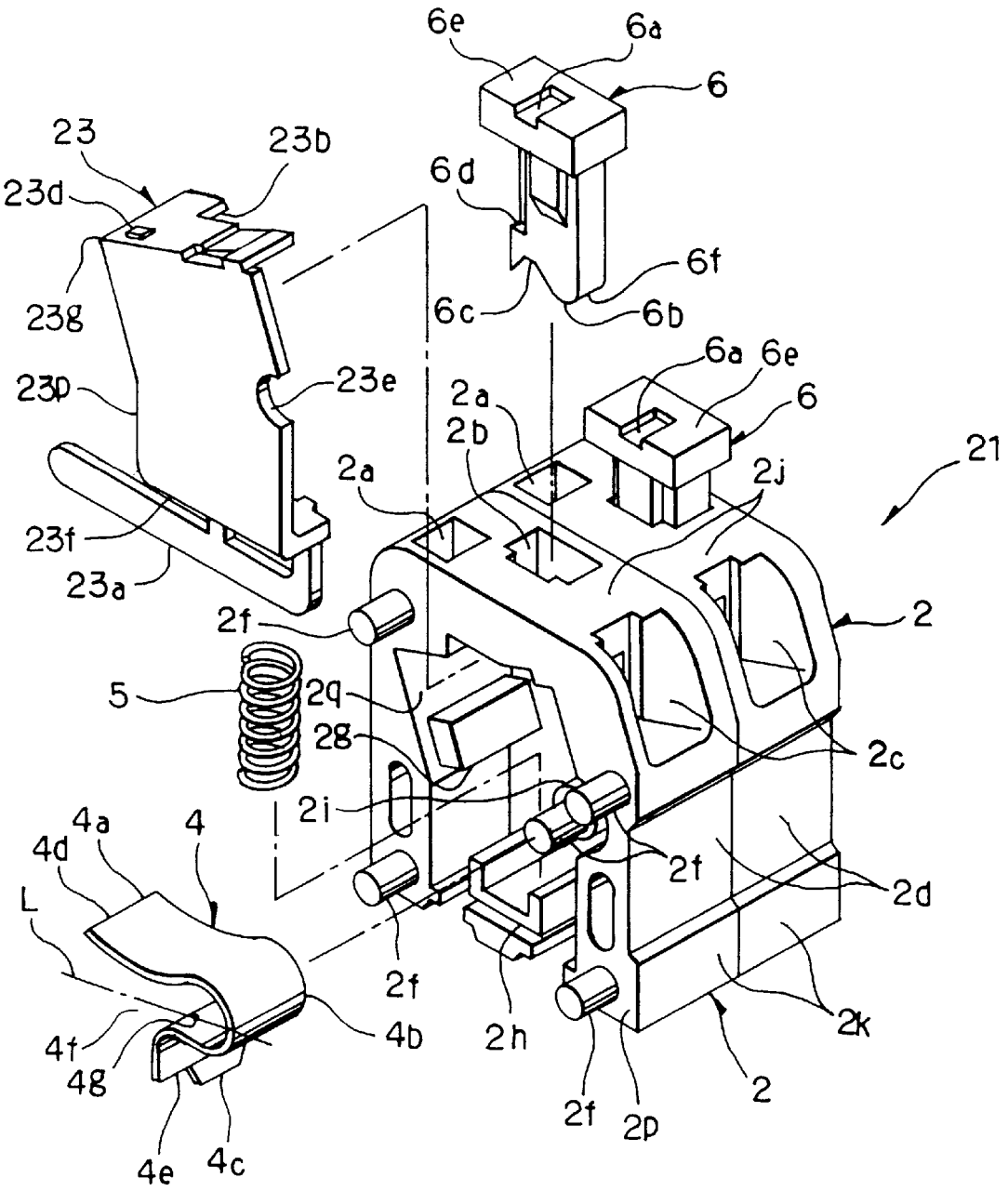
FIG. 13 is an oblique view of a second embodiment of a terminal unit of the invention shown as being exploded.

Now in reference to FIG. 13 where a second embodiment of the invention is shown, a terminal unit 21 has a metal terminal 23 which has an L-shape lead 23*a* formed at the lower end 23*f* thereof and extending in the direction normal to the direction in which the push button 6 is pushed. The other portions of the metal terminal 23 are formed in the same manner as the metal terminal 3 of the first embodiment though the respective portions are denoted with the different reference numbers such as cutout 23*b*, edge (not shown but corresponding to the edge 3*c* in FIG. 7), projection 23*d*, cutout 23*e*, lower bent portion 23*f*, upper bent portion 23*g*, opposite sides 23*p*.

Figure 14:
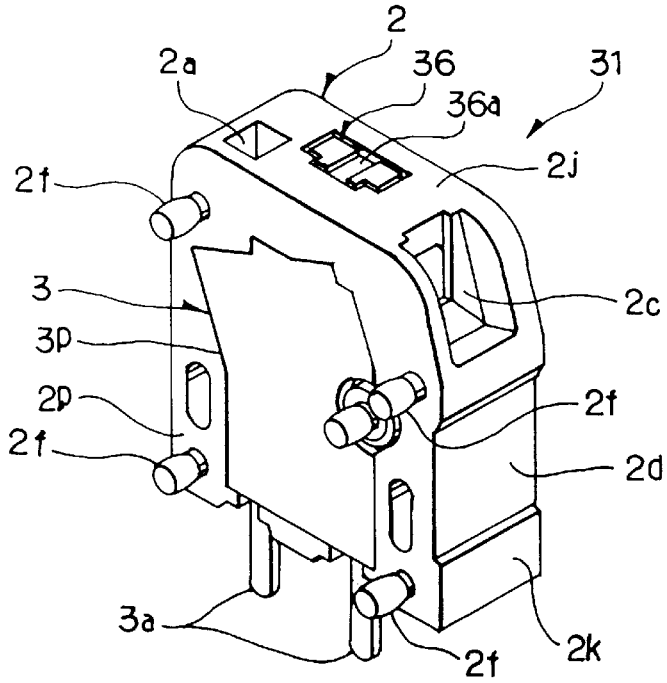
Figure 15:
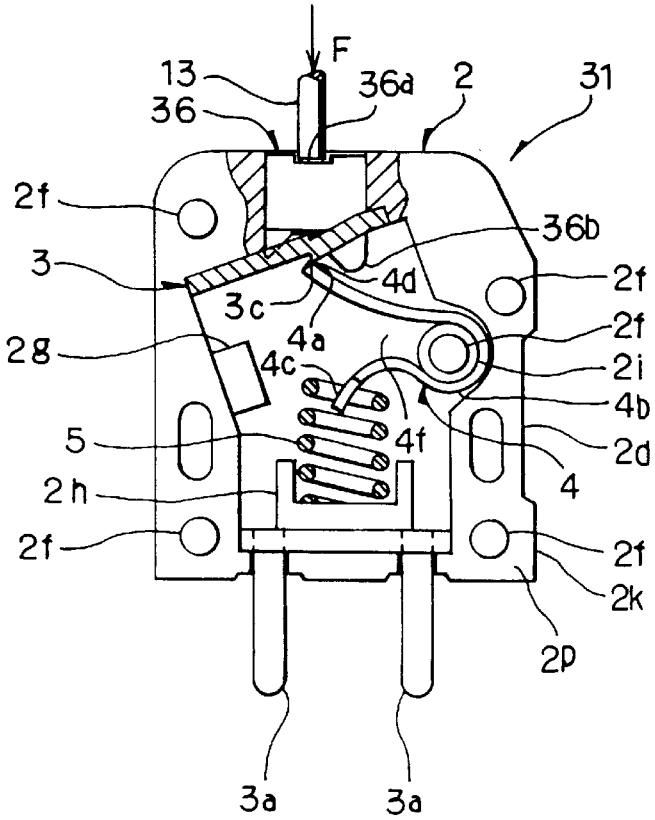

In reference to FIGS. 14 and 15 where a third embodiment of the invention is shown, the terminal unit 31 has a push button 36 which is different from the push button 6 of the first embodiment. The push button 36 has a head top 36*a* so formed as to be placed slightly below the top surface 2*j* of the casing 2 when the push button 36 is assembled into the casing 2. The other portions of the push button 36 are formed in the same manner as the push button 6 of the first embodiment.

With the embodiments of the invention being constructed as mentioned above, the operation is as follows:

In case of the terminal unit 1 of the first embodiment, a desired number of terminal units 1 are put into combination as shown in FIGS. 1 and 2 and the terminal unit 1 arranged at the last end is covered with the end plate 11 which is attached to the terminal unit 1 through the connecting projections 2*f*.

Figure 10:
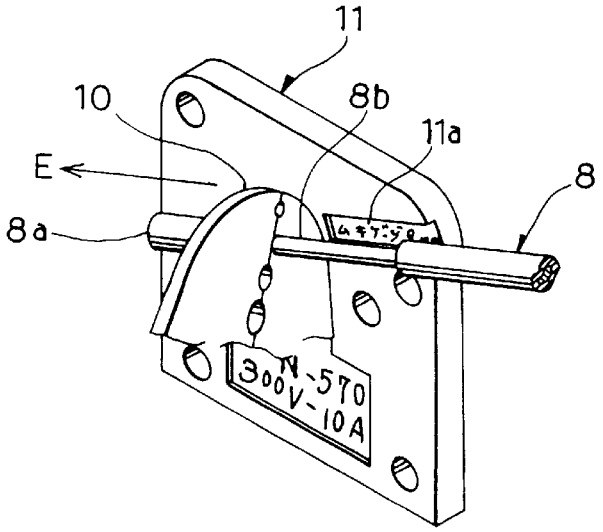

Prior to connecting the electrically conductive wire 8 to the terminal unit 1, the electrically conductive wire 8 is determined with respect to the length of the sheath 8*a* to be peeled by means of a peeling gauge 11*a* provided on the end plate 11 as shown in FIGS. 1 and 10. Then the electrically conductive wire 8 is made naked by peeling the sheath 8*a* of determined length by means of a wire stripper 10 which is operated to clamp the sheathe wire 8 and subsequently moved in the direction as shown by the arrow E.

Figure 11:
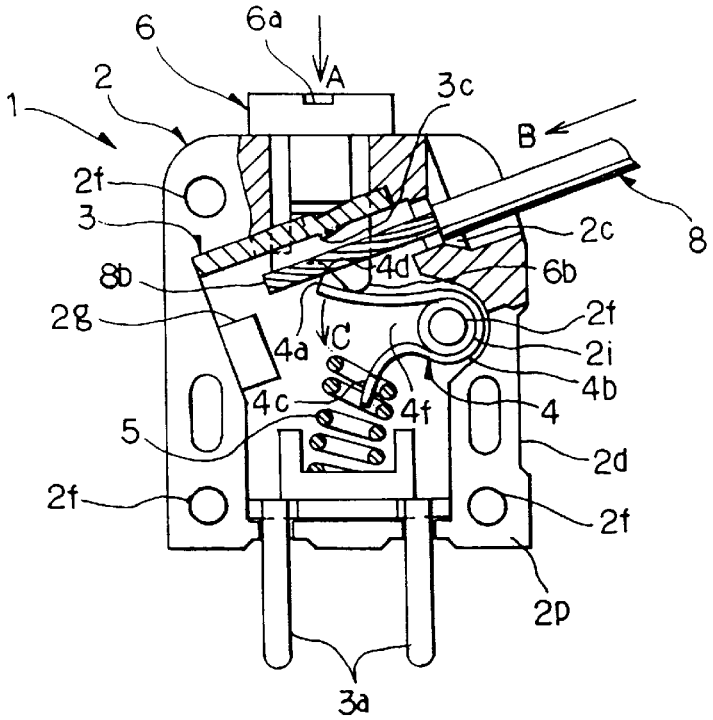
Figure 12:
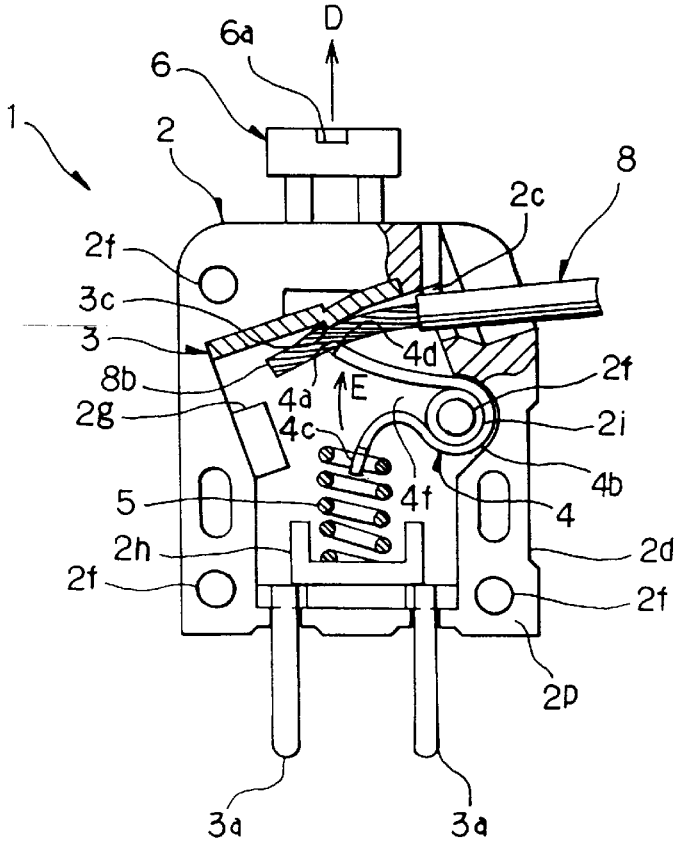

Subsequently as shown in FIGS. 11 and 12, the naked portion of the electrically conductive wire 8 is inserted into the wire introducing opening 2*c* of the casing 2 in the direction as shown by the arrow B while the push button 6 is pushed down in the direction as shown in the arrow A.

With the push button 6 being pushed down, the plate spring 4 is rotated around the support pin 2*i* in the direction as shown by the arrow C against the spring action of the compression coil spring 5. Thus the wire pressing part 4*a* of the plate spring 4 is disengaged from the edge 3*c* of the metal terminal 3 and provides a gap between the edge 3*c* and the wire pressing part 4*a* so that the naked portion of the electrically conductive wire 8 may pass through the gap. Since the wire pressing part 4*a* slides along the recessed part 6*c* at the lower end 6*f* of the push button 6 while the plate spring 4 is rotated around the support pin 2*i* of the casing 2, the plate spring 4 will not be disengaged from the push button 6 when the push button 6 is pushed down to the end. Further with the synergism composed of the relatively soft spring property of the compression coil spring 5, the relatively hard spring property of the plate spring 4 and the utilization of the lever principle, the force required to push the push button may be restrained approximately to 10.8N (1.1 kgf) at most. In other words, the required pushing force may be reduced to approximately ½ of the force of about 21.6N (2.2 kgf) in the case of the conventional terminal unit provided with the plate spring only.

Further with use of the compression coil spring 5, the pushing stroke may be longer and consistently stabilized.

When the push button 6 is released after it is pushed down to the end, the plate spring 4 is rotated up in the direction as shown by the arrow E due to the return action of the compression coil spring 5. Then the wire pressing part 4*a* of the plate spring 4 presses the naked portion 8*b* of the electrically conductive wire 8 against the edge 3*c* of the metal terminal 3, thereby to electrically connect the wire 8 to the metal terminal 3. In the meantime, the push button 6 is returned back in the direction as shown by the arrow D to the initial position as shown in FIG. 12.

Figure 16:
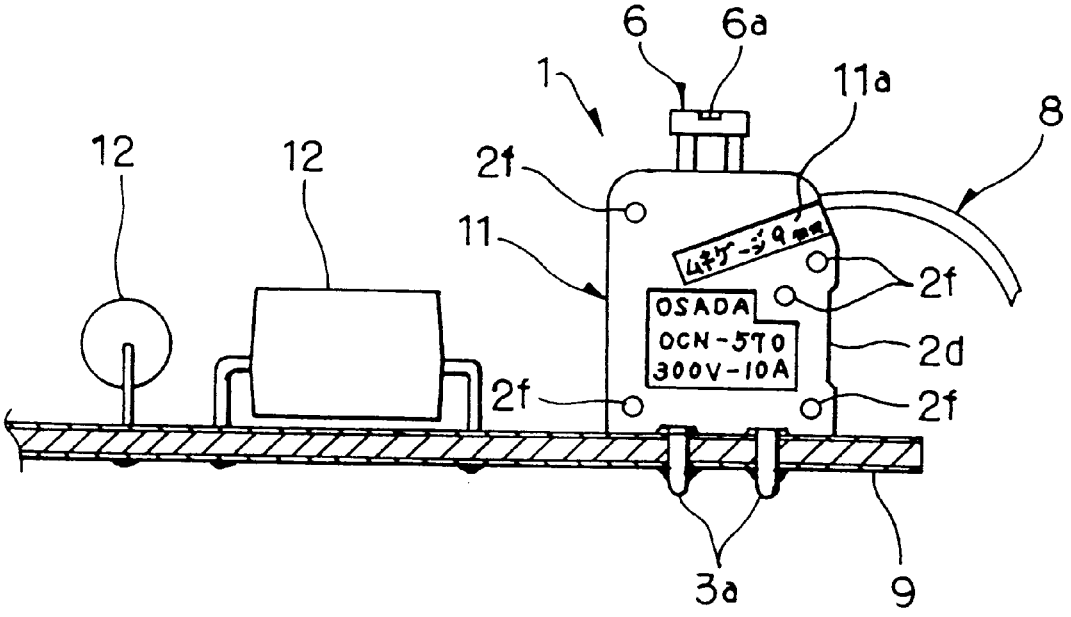

As shown in FIG. 16, the terminal unit 1 is mounted on the printed board 9 by soldering the leads 3*a* of the terminal unit 1 to the printed board 9 together with the other electronic elements.

The terminal unit 21 according to the second embodiment of the invention may be operated in the same way as that of the terminal unit 1 of the first embodiment to connect the electrically conductive wire 8 to the metal terminal 23 thereof. Since the terminal unit 21 has the metal terminal 23 having the L-shape lead 23*a* extending laterally thereof, the terminal unit 21 is adapted to being mounted to a printed board which may restrict the height of the electronic elements including terminal unit 21, or to being mounted to the printed board 9 in such manner that the push button 6 may be parallel with the printed board 9 irrespectively of the layout of wiring.

The terminal unit 31 according the third embodiment of the invention has the push button 36 having the head top 36*a* positioned below the top surface 2*j* of the casing 2. It is, therefore, required to use a tool such as a driver 13 to push the push button 36 in the direction as shown by the arrow F when the electrically conductive wire 8 is connected to the terminal unit 31.

The invention being thus described, it will be obvious that the same may be varied in many ways. Such variations are not to be regarded as a departure of the spirit and scope of the invention, and all such modifications are intended to be included within the scope of the following claims.

What is claimed is:

1. A terminal unit having a casing containing therein a metal terminal so structured as to hold an electrically conductive wire in cooperation with a plate spring with electrically conductive connection established between the metal terminal and the electrically conductive wire, said terminal unit comprising:

a support pin extending laterally of said casing, said plate spring having opposite ends and being bent intermediate the opposite ends to provide an attaching portion for rotatably supporting the plate spring on the support pin, one of said opposite ends having a projection formed thereat;

a compression coil spring positioned in said casing and having one end portion for receiving said projection of said one end of said plate spring and normally pressing the other end of said plate spring against an edge of said metal terminal; and a push button operated in one direction to press said other end of said plate spring against the spring action of said compression coil spring, thereby to rotatably disengage the other of the opposite ends of said plate spring from said edge of said metal terminal and provide a gap between said edge of said metal terminal and said other end of said plate spring for allowing said electrically conductive wire to be inserted therethrough, said push button, said compression coil spring and said plate spring being arranged substantially in alignment with each other so that said operation of said push button in said one direction may cause rotation of said plate spring while being elastically deformed and simultaneously compress said compression coil spring.

2. A terminal unit having a casing containing therein a metal terminal so structured as to hold an electrically conductive wire in cooperation with a plate spring with electrically conductive connection established between the metal terminal and the electrically conductive wire, said terminal unit comprising:

a support pin extending laterally of said casing, said plate spring having opposite ends and being bent intermediate the opposite ends in a shape of hair pin to provide an attaching portion for rotatably supporting the plate spring on said support pin, the opposite ends defining an opening therebetween, and one of said ends having a projection formed thereat;

a compression coil spring positioned in said casing and having one end portion for receiving said projection of said one end of said plate spring and normally pressing the other end of said plate spring against an edge of said metal terminal; and a push button having a head protruded out from said casing so as to be operated thereat, said push button being pushed in one direction to press the other of the opposite ends of said plate spring against the spring action of said compression coil spring, thereby to rotatably disengage said other end of said plate spring from said edge of said metal terminal and provide a gap between said edge of said metal terminal and said other end of said plate spring for allowing said electrically conductive wire to be inserted therethrough, said push button, said compression coil spring and said projection of said one end and said other end of said plate spring being arranged substantially in alignment with each other with a straight line passing said bent portion and said opening of said plate spring extending in a direction normal to said direction in which said push button is operated so that said pushing operation of said push button may cause rotation of said plate spring while being elastically deformed and simultaneously compress said compression coil spring.

3. A terminal unit having a casing containing therein a metal terminal so structured as to hold an electrically conductive wire in cooperation with a plate spring with electrically conductive connection established between the metal terminal and the electrically conductive wire, said terminal unit comprising:

a support pin extending laterally of said casing, said plate spring having opposite ends and being bent intermediate the opposite ends in a shape of hair pin to provide an attaching portion for rotatably supporting the plate spring on said support pin, the opposite ends defining an opening therebetween, and one of said ends having a projection formed thereat;

a compression coil spring positioned in said casing and having one end portion for receiving said projection of said one end of said plate spring and normally pressing the other end of said plate spring against an edge of said metal terminal; and a push button having a head protruded out from said casing so as to be operated thereat, said push button being pushed in one direction to press the other of the opposite ends of said plate spring against the spring action of said compression coil spring, thereby to rotatably disengage said other end of said plate spring from said edge of said metal terminal and provide a gap between said edge of said metal terminal and said other end of said plate spring for allowing said electrically conductive wire to be inserted therethrough, said push button, said compression coil spring and said projection of said one end and said other end of said plate spring being arranged substantially in alignment with each other while said plate spring is arranged in such a manner as a straight line passing said bent portion and said opening of said plate spring extending normal to said direction in which said push button is operated so that said pushing operation of said push button may cause rotation of said plate spring while being elastically deformed which may simultaneously compress said compression coil spring, said metal terminal having a plurality of leads extending in a direction normal to a plane of a printed board to which said terminal unit is mounted.

4. A terminal unit having a casing containing therein a metal terminal so structured as to hold an electrically conductive wire in cooperation with a plate spring with electrically conductive connection established between the metal terminal and the electrically conductive wire, said terminal unit comprising:

a support pin extending laterally of said casing, said plate spring having opposite ends and being bent intermediate the opposite ends in a shape of hair pin to provide an attaching portion for rotatably supporting the plate spring on said support pin, the opposite ends defining an opening therebetween, and one of said ends having a projection formed thereat;

a compression coil spring positioned in said casing and having one end portion for receiving said projection of said one end of said plate spring and normally pressing the other end of said plate spring against an edge of said metal terminal; and a push button having a head protruded out from said casing so as to be operated thereat, said push button being pushed in one direction to press the other of the opposite ends of said plate spring against the spring action of said compression coil spring, thereby to rotatably disengage said other end of said plate spring from said edge of said metal terminal and provide a gap between said edge of said metal terminal and said other end of said plate spring for allowing said electrically conductive wire to be inserted therethrough, said push button, said compression coil spring and said projection of said one end and said other end of said plate spring being arranged substantially in alignment with each other while said plate spring is arranged in such a manner that a straight line passing said bent portion and said opening of said plate spring extends normal to said direction in which said push button is operated, so that said pushing operation of said push button may cause rotation of said plate spring while being elastically deformed which may simultaneously compress said compression coil spring, said metal terminal having a least one lead in a shape of L, an essential part of which extending in a direction parallel to a plane of a printed board to which said terminal unit is mounted.

5. A terminal unit having a casing containing therein a metal terminal so structured as to hold an electrically conductive wire in cooperation with a plate spring with electrically conductive connection established between the metal terminal and the electrically conductive wire, said terminal unit comprising:

a support pin extending laterally of said casing, said plate spring having opposite ends and being bent intermediate the opposite ends in a shape of hair pin to provide an attaching portion for rotatably supporting the plate spring on said support pin, the opposite ends defining an opening therebetween, and one of said ends having a projection formed thereat;

a compression coil spring positioned in said casing and having one end portion for receiving said projection of said one end of said plate spring and normally pressing the other end of said plate spring against an edge of said metal terminal; and a push button having a head normally positioned substantially inside of said casing so as to be operated thereat by means of a tool, said push button being pushed in one direction to press the other of the opposite ends of said plate spring against the spring action of said compression coil spring, thereby to rotatably disengage said other end of said plate spring from said edge of said metal terminal and provide a gap between said edge of said metal terminal and said other end of said plate spring for allowing said electrically conductive wire to be inserted therethrough, said push button, said compression coil spring and said projection of said one end and said other end of said plate spring being arranged substantially in alignment with each other while said plate spring is arranged in such a manner that a straight line passing said bent portion and said opening of said plate spring extends normal to said direction in which said push button is operated, so that said pushing operation of said push button may cause rotation of said plate spring while being elastically deformed which may simultaneously compress said compression coil spring.

* * * * *